United States Patent [19]

Brotz

[11] Patent Number: 4,598,755

[45] Date of Patent: Jul. 8, 1986

[54] METHOD OF PRODUCING A WRAPPED CONTINUOUS LENGTH STRUCTURE

[76] Inventor: Gregory R. Brotz, P.O. Box 1322, Sheboygan, Wis. 53081

[21] Appl. No.: 738,403

[22] Filed: May 28, 1985

[51] Int. Cl.[4] ..... B22C 9/10; B22D 11/00; B22D 11/12

[52] U.S. Cl. ..... 164/5; 53/122; 53/428; 53/450; 164/37; 164/476; 164/477; 264/166; 264/317; 264/DIG. 44

[58] Field of Search ..... 164/5, 6, 15, 37, 159, 164/167, 169, 228, 232, 459, 476, 477; 53/442, 428, 449, 450, 122; 264/166, 317, DIG. 44; 428/377

[56] References Cited

U.S. PATENT DOCUMENTS

| | | | |
|---|---|---|---|
| 935,254 | 9/1909 | Gleason | 264/317 |
| 2,338,781 | 1/1944 | Porter | 164/5 X |
| 4,163,827 | 8/1979 | Nieman et al. | 428/377 |

FOREIGN PATENT DOCUMENTS

| | | | |
|---|---|---|---|
| 238881 | 5/1926 | United Kingdom | 264/317 |

*Primary Examiner*—Nicholas P. Godici
*Assistant Examiner*—J. Reed Batten, Jr.
*Attorney, Agent, or Firm*—William Nitkin

[57] ABSTRACT

An ultra-light structure is produced by continuously molding a green sand core, forming a material in the mold pattern in the core which solidifies to form a solidified framework, removing the green sand core and wrapping the resultant solidified framework structure in a material.

10 Claims, 7 Drawing Figures

METHOD OF PRODUCING A WRAPPED CONTINUOUS LENGTH STRUCTURE

BACKGROUND OF THE INVENTION

1. Field of the Invention

The structure and method of this invention reside in the field of composite structures and more particularly relate to a structure having a cast framework wrapped with materials and treated to produce a strong lightweight structural member.

2. Description of the Prior Art

Green sand casting has long been used to produce castings which process consists of pouring molten metal into a green sand mold and after the metal solidifies, the metal cast product is removed therefrom.

Continuous belt casting processes have been utilized in the prior art such as described in U.S. Pat. No. 1,342,127 to Mellen wherein a continuously cast hollow bar is produced through a belt caster carrying a plurality of molds on caterpillar-type belts. Other devices utilize similar molds such as seen in U.S. Pat. No. 3,552,478 to Lauener which discloses a method of supplying metal to a continuous casting mold. The passing of a continuous casting of an extrusion through a coolant is disclosed in U.S. Pat. No. 3,874,438 to Phillips et al, a method of injecting sand into a molding machine is shown in U.S. Pat. No. 3,274,651 to Oliveira, and a method and apparatus for sand recovery is shown in U.S. Pat. No. 2,515,194 to Christensen. None of the prior art known to the Applicant discloses the process as described and claimed below for the production of a continuously cast composite structural item.

SUMMARY OF THE INVENTION

It is an object of this invention to produce structural members in a variety of configurations. Pipes can be produced as well as structures having different characteristics depending upon the internal structure of the casting and the material wrapped around the casting during its manufacture. These structures can be used for building purposes or any other purpose where a structural, lightweight and inexpensive item is needed.

The structure of this invention is produced by a process which utilizes a continuous molding device having a plurality of belt molding blocks. Continuous molding belts are old in the art and usually consist of two belts with a plurality of molds, the opposing molds joining against one another as the belts move carrying material to be molded between them to where the molding exits at the other end of the belt molder as a finished product.

The device of this invention can utilize three of such molding belts at approximately 120 degrees to one another to produce a green sand core or core of equivalent material. The green sand utilized in this invention is held in a container and in one embodiment portions of the sand are entered into the belt molder by a reciprocating ram or, in another embodiment, by high air pressure means. When the green sand core formed by the belt molder comes out, it has a pattern embossed and formed in it by the belt molds. The green sand core remains an integral piece as it passes through a casting collar which contains molten metal. The molten metal fills in areas of the formed pattern in the molded core and passes into its interior if the core contains hollow portions in that direction, and the molten metal solidifies quickly. The metal though does not substantially form beyond the circumference of the green sand core as the size of the diameter of the casting collar is close to the size of the diameter of the green sand core. It should be noted that while the examples disclosed herein use molten metal, other equivalent materials that in one state are liquid and which in a second state can be solidified can be used in place of molten metal. Examples of such materials include, but are not limited to, molten plastics or liquid resins that can be solidified by a variety of processes. One shape that can be cast, for example, is a cylindrical metal mesh. The metal mesh solidifies, carrying inside it the green sand of the core. It then passes under a high-pressure air hose which blows the green sand out of the core into a green sand return means. Other equivalent means can be used to remove the greens and from the core such as vibrating means and the like. The green sand return means can utilize a rotating auger-type movement to move and reintroduce the green sand back into the green sand container so that it can be continuously reused in the process of this invention. The diameter of the now-hollow cylindrical metal mesh casting can then be compressed, stretched and elongated by pull-down rollers and the casting then passed into a wrapping device. The wrapping device can contain one or more rolls of a shrinkwrap material which may contain other elements as discussed below. In the structure's basic form the shrinkwrap material is wrapped around the cast cylindrical metal mesh by the wrapping device, and the wrapped cylindrical metal mesh is then passed through an oven which shrinks the wrap, constricting same against the cylindrical metal mesh and hardening it to form a very strong lightweight structure suitable for a variety of uses.

DESCRIPTION OF THE PREFERRED EMBODIMENT(S)

Figure 1:
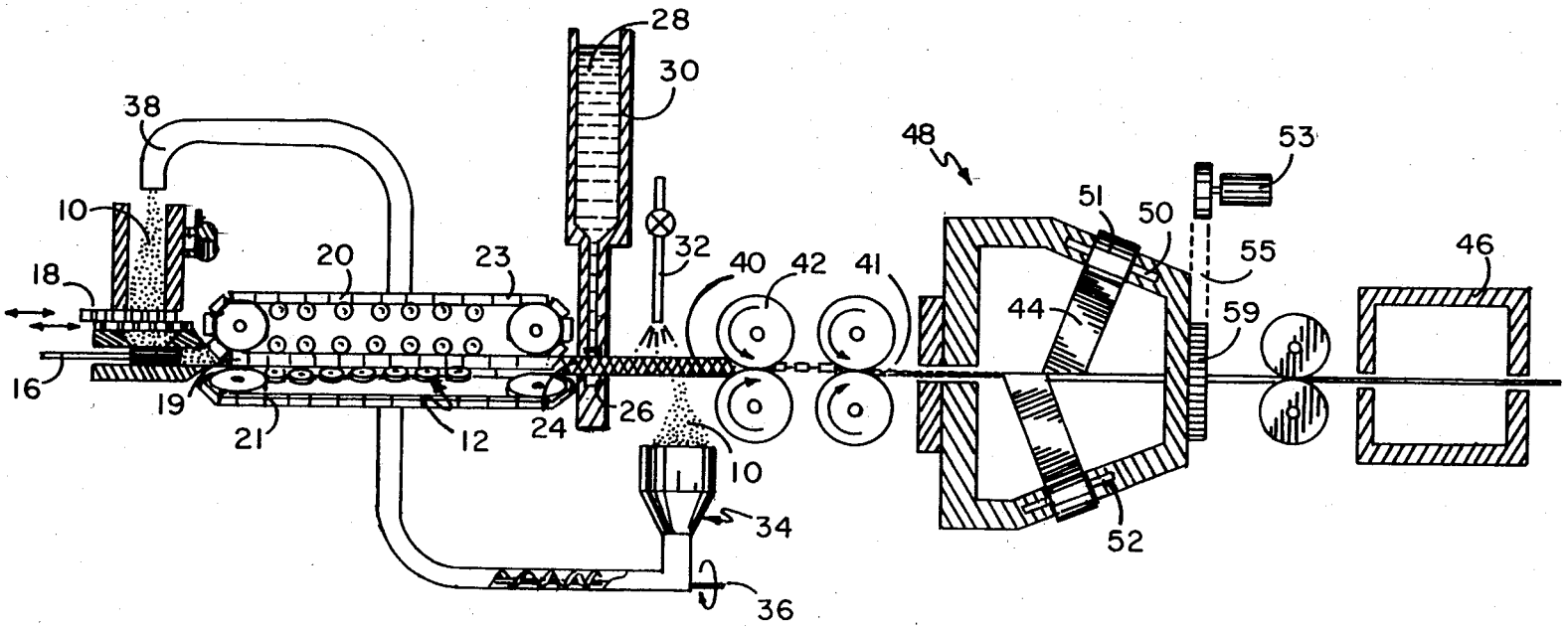
FIG. 1 illustrates a production line process for production of the structure of this invention.
Figure 2:
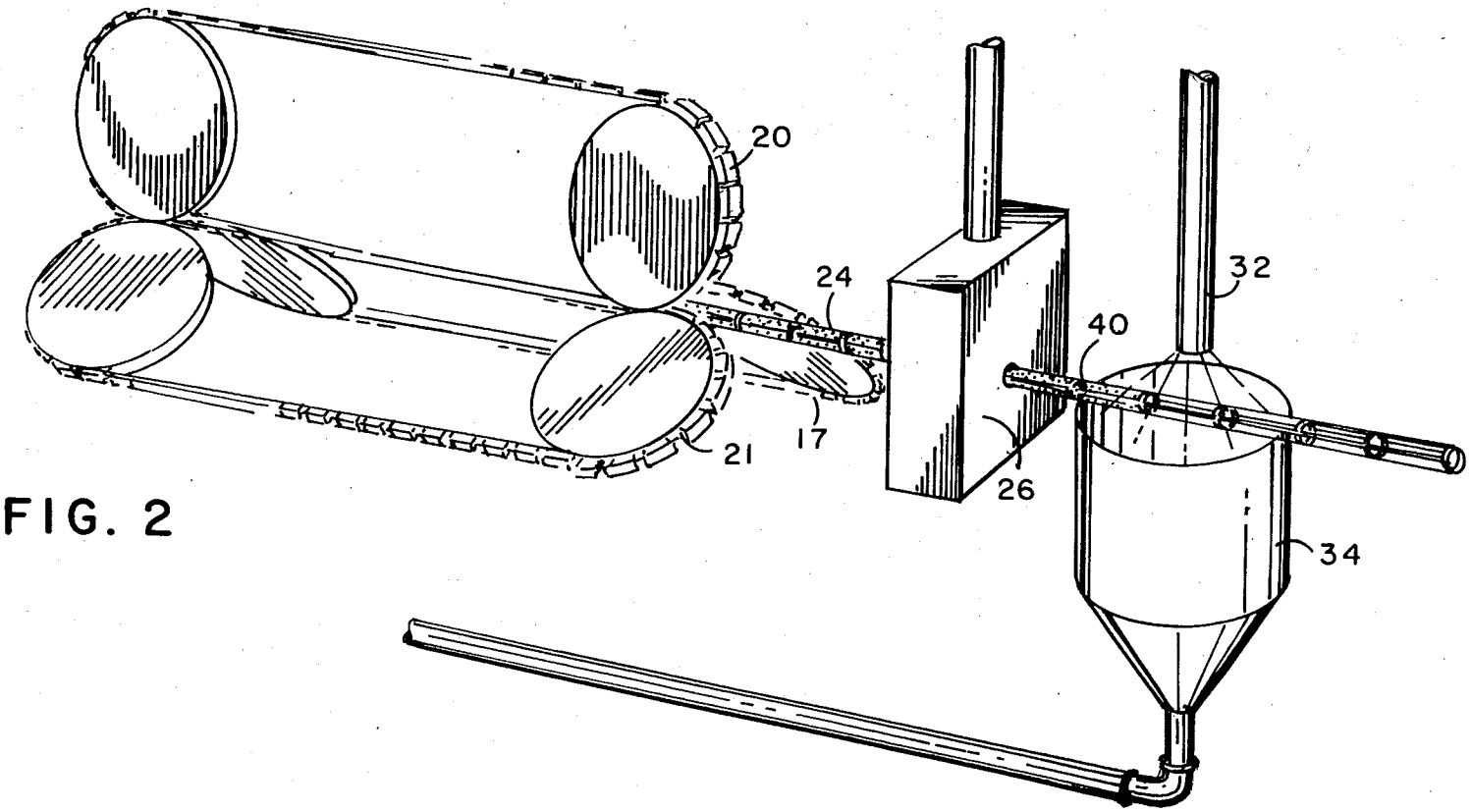
FIG. 2 illustrates a perspective sectional view of a portion of the production line shown in FIG. 1.
Figure 5:
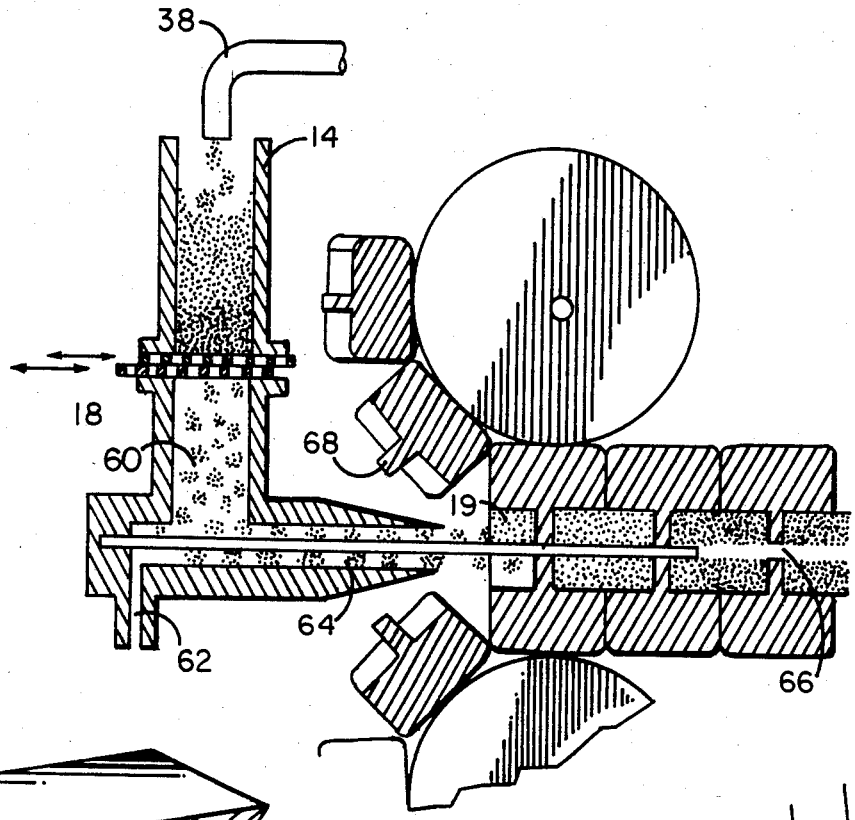
FIG. 5 illustrates high-pressure air means entering green sand into the mold cavity.

FIG. 1 illustrates a production line which continuously produces the structure of this invention. Seen in this view is continuous molding device 12 which can be comprised of three molding belts, two of which are visible and the third, being positioned behind the first and second, not visible. The third belt is visible though in FIG. 2. The molding belts are positioned at approximately 120 degrees to one another and have movable belts as is known in the prior art composed of molding block elements, each carrying a particular desired design. The use of three molding belts allows for more intricate designs to be produced. Green sand 10 which is held in green sand container 14 enters at the left end of continuous molding device 12. Seen in this view is reciprocating ram 16 pushing the green sand out of green sand container 14 into the next newly-formed receiving mold cavity 19 so that it can be pulled along by the belt molder to be formed and extruded as green sand core 24 at the other end. Metering gates 18 move back and forth to allow varying amounts of sand to enter into the chamber in front of reciprocating ram 16. In other embodiments, such as illustrated in FIG. 5, high-pressure air can be used to introduce the sand into mold cavity 19. Molded green sand core 24 proceeds out of the belt molder and passes through casting collar 26 which receives a supply of molten metal 28 from molten metal container 30. Molten metal 28 engulfs molded green sand core 24 within the casting collar 26, filling in the molded areas around and within green sand core 24, and forms a cast metal structure which solidifies as it moves out of the casting collar and is cooled. The metal solidifies quickly in the molded shape, herein shown for example as a grid lattice forming a metal mesh. This metal mesh casting 40 passes under high-pressure air supply means 32 which blows out the loosely-adhering green sand core from the interior of the casting so that it breaks up and falls out in particle form. Equivalent sand-removal means can also be used. Green sand 10 can be collected by sand return means 34 such as a rotating auger 36 or equivalent means to pass the sand through sand return pipe 38 back into green sand container 14 to be reused. FIG. 2 shows a perspective view of green sand core 24 emerging from molding block belts 17, 20 and 21 and passing into casting collar 26 which has a chamber therein that surrounds green sand core 24 and contains the molten metal. The opening in casting collar 26 into and out of which green sand core 24 passes is of a size close enough to the cross-sectional size of green sand core 24 to retain most of the molten metal within the chamber in casting collar 26 but to allow the molten metal to fill in the molded areas of the core to form metal mesh casting 40. The green sand is blown out of the metal mesh by pressure air supply means 32 and the sand falls into return means 34. Cylindrical metal mesh casting 40 with its green sand core removed can be moved along by pulldown rollers 42 which compress casting 40 into a shape having a smaller diameter and which shape is elongated. The object of pulling down the size of the diameter of the cylindrical metal mesh casting 40 is to increase the tensile strength of the structure and also to increase it flexure strength to a certain degree. Compressed casting 41 enters an opening within the framework of wrapping device 48. The wrapping device is adapted to rotate around metal casting 41. The wrapping device can be driven by motor 53 through belt 55 around pulley 59 and supported by structure not seen in FIG. 1 to allow the casting to pass through the entry means in the front and through exit means provided in the rear so that the casting passes without interference therethrough. A roll 51 of wrapping material is positioned on roll holder 50 on wrapping device 48 and wraps around metal casting 41 as wrapping device 48 rotates therearound. Wrapping material from more than one roll of material can be wrapped around the metal casting at one time and a second roll holder 52 also seen in this view holding a second roll of wrapping material. This wrapping material can be shrinkwrap 44 which, as wrapping device 48 rotates, wraps tightly around the compressed metal casting 41. The wrapped casting then passes out of wrapping device 48 into heating means such as oven 46 where the wrapped casting is heated causing the shrinkwrap to tightly bind itself to the metal casting. Due to the interior structural material of the casting, a very strong, lightweight structure is obtained which can be utilized for a variety of purposes.

The shrinkwrap material can be composed of more than one material. In one embodiment the shrinkwrap can be pretreated with a layer of glass fibers coated with a heat-curable binder such as a resin which, when the wrapped structure is passed through an oven or equivalent heating means, hardens as the shrinkwrap contracts and tightens around the casting, creating a stronger integral structure. Such a structure will resist any increase in its diameter or width and therefore would resist kinking which causes an increase in diameter or width from the stress and physical action at the point of bending. It is of further advantage to have the glass fibers layered with their axes parallel with the axis of the structure to help increase the flexural strength of the finished product. Other types of wrapping can be utilized such as a resin-impregnated glass mat or veil and in alternate embodiments, a resin-impregnated paper or spirally-wound glass roving or carbon-fiber roving can be used. In some cases articles can be produced using the process of this invention where the composite shrinkwrap wound around the casting exceeds the strength of the interior cast metal framework so that the shape of the metal casting really acts as an inexpensive frame on which to hold the wrapping which becomes the stronger portion of the resulting structure. In some embodiments copper or other work-hardenable metal can be cast and hardened by ultrasonic vibration to decrease its flexibility.

In certain applications it may be desirable to have one or more pins incorporated in the molds which would protrude inwardly into the green sand core. In such embodiments it may be desirable to have such molds lifted straight out of the core so that the protruding pins in the molds will not damage the core as the mold comes away from the core at an angle at the end of the belt roller as the molds pass around the rollers. Therefore means can be provided in some embodiments at one end of the belt roller to have the mold pulled directly out of the core before the molds pass around the end of the rollers. Such means can include positioning the end of the roller away from the core with mechanical means to withdraw the mold straight back from green sand core 24.

Figure 6:
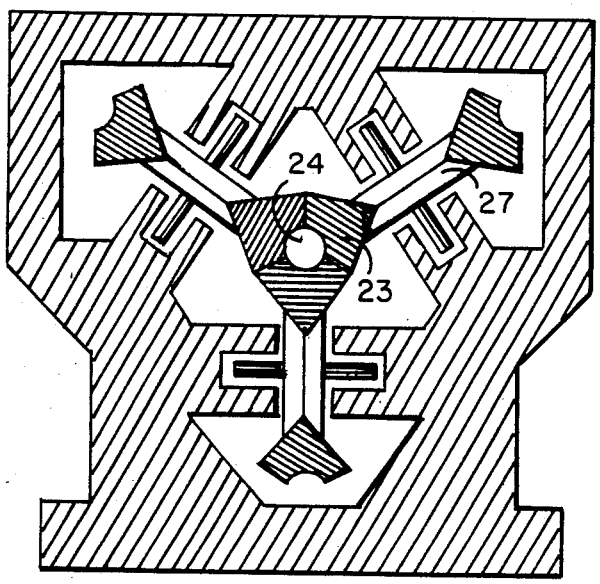
FIG. 6 illustrates a cross-sectional view of the belt molder with the mold blocks pressed against the green sand core.
Figure 7:
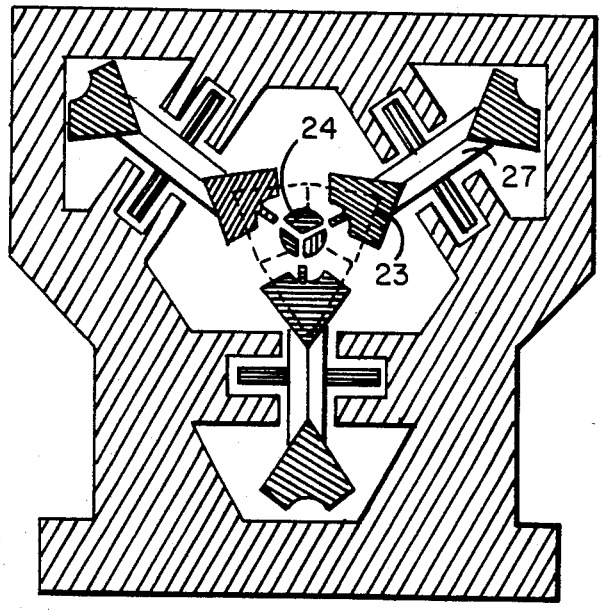
FIG. 7 illustrates the cross-section of FIG. 6 with the molding blocks pulling away from the green sand core.

FIG. 6 illustrates a cross-sectional view of the belt molder of this invention. Seen in this view are molds 23 around the green sand core just before the molds are about to pass around rollers 27. In FIG. 7 it is seen that molds 23 have continued in their process around rollers 27 and have pulled away from green sand core 24 leaving the core in the center to be delivered into casting collar 26.

Figure 3:
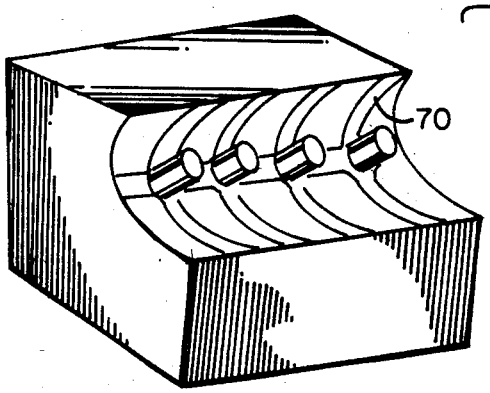
FIG. 3 illustrates ridge details of the molding blocks used for making impressions on the green sand core.
Figure 4:
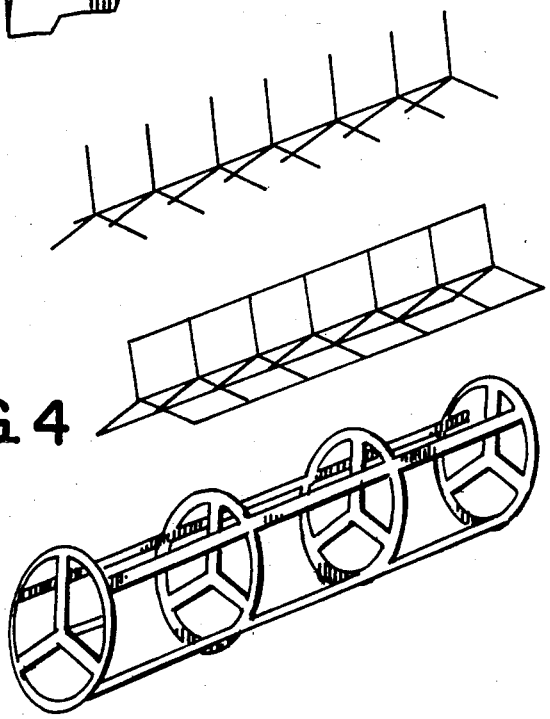
FIG. 4 illustrates a plurality of designs of internal metal castings that can be produced by the process of this invention.

FIG. 5 illustrates the high-pressure air delivery of green sand into the mold cavity. Seen in this view is the green sand returning from sand return means 34 through sand pipe 38 into green sand container 14 with metering gates 18 allowing a certain amount of sand to pass therethrough. The sand falls into channnel 60, is picked up by high-pressure air entering through port 62, and blown directly into mold cavity 19 formed when the molding blocks come around rollers 27. In some embodiments core pin 64 can be used to form hollow channel 66 in the core as the core is being formed. As the core passes beyond the core pin, hollow channel 66 remains in the molded green sand so that in this particular embodiment the molten metal introduced in the casting collar will fill in not only hollow channel 66 created by the core pin but also the areas formed by protrusions 68 of the molding pins which will form an attached metal center core within the cast framework such as seen in the first two embodiments of FIG. 4 showing various structural configurations which could be produced by various arrangements of protrusions and intrusions on the molding blocks. Such protrusions are seen in FIG. 3 showing the details on a molding block with ridges 70 thereon for making impressions. It is an object of this invention that the structure formed out of green sand from the continuous molding device can have any configuration that will accept the molten metal to form a longitudinal casting. The structural designs and shapes that can be produced by the method of this invention should not be considered limited to the designs and shapes discussed and illustrated herein since other designs and shapes can be produced which would certainly be included within the spirit and scope of this invention.

Other materials that can be utilized within the composite shrinkwrap discussed above can include foaming agents which can be added to the binder. For example, a heat-curable epoxy binder with hardener can be combined with a blowing agent and chopped or milled glass fiber and coated onto the shrinkwrap and the shrinkwrap is wrapped around the cast framework and heated. As the heat penetrates, the foaming agent foams the binder, and the heat cures the resin. At the same time, the heat also causes the shrinkwrap to shrink. As the binder foams, the shrinkwrap resists the foaming and the resulting structure is extremely strong.

Although the present invention has been described with reference to particular embodiments, it will be apparent to those skilled in the art that variations and modifications can be substituted therefor without departing from the principles and spirit of the invention.

I claim:

1. A process for making a continuously-produced structure comprising the steps of:

continuously molding green sand to form a molded green sand core;

forming a mold pattern in said core;

pouring molten material in the mold pattern formed in said green sand core;

solidifying said poured material;

removing said green sand from said solidified material structure;

wrapping said solidified structure with wrapping material; and treating said wrapped structure to strengthen said wrapping material.

2. The process of claim 1 wherein said molten material is molten metal.

3. The process of claim 1 further including before the step of wrapping said solidified structure the steps of:

passing said solidified structure through pull-down rollers; and reducing the dimension of said solidified structure.

4. The process of claim 1 wherein the step of removing said green sand from said solidified material structure includes blowing air on said solidified material structure.

5. The process of claim 4 further including the step of: returning said green sand to a green sand container.

6. The process of claim 1 wherein said wrapping material is a shrinkwrap material and said treating step includes:

heating said shrinkwrapped structure; and shrinking said shrinkwrap material to form a tightly-wrapped structure.

7. The process of claim 6 wherein said shrinkwrap material contains resins and fibrous materials.

8. The process of claim 1 wherein said green sand is molded in a multi-part continuous caterpillar-type belt molder.

9. The process of claim 8 further including the step of entering said green sand into said multi-part continuous belt molder by means of a reciprocating ram forcing sand coming from said green sand container into one end of said continuous belt molder.

10. The process of claim 9 wherein said solidified material around said molded green sand core is formed by a casting collar, said process further including the step of:

depositing molten material from a molten supply around said green sand core.

* * * * *